US007941945B2

(12) United States Patent
Gerber

(10) Patent No.: US 7,941,945 B2
(45) Date of Patent: May 17, 2011

(54) ARTICLE OF FOOTWEAR WITH HEEL TRACTION ELEMENTS

(75) Inventor: Clifford B. Gerber, West Linn, OR (US)

(73) Assignee: Nike, Inc., Beaverton, OR (US)

( * ) Notice: Subject to any disclaimer, the term of this patent is extended or adjusted under 35 U.S.C. 154(b) by 864 days.

(21) Appl. No.: 11/873,828

(22) Filed: Oct. 17, 2007

(65) Prior Publication Data

US 2009/0100718 A1 Apr. 23, 2009

(51) Int. Cl.
*A43B 5/00* (2006.01)

(52) U.S. Cl. ..... 36/59 R; 36/59 C; 36/134

(58) Field of Classification Search ..... 036/59 R, 036/59 C, 67 R, 134, 126–129, 114
See application file for complete search history.

(56) References Cited

U.S. PATENT DOCUMENTS

| | | | | | |
|---|---|---|---|---|---|
| D206,222 | S | * | 11/1966 | Mostile | D2/924 |
| 4,060,917 | A | | 12/1977 | Canale | |
| 4,085,527 | A | * | 4/1978 | Riggs | 36/114 |
| 4,098,011 | A | * | 7/1978 | Bowerman et al. | 36/129 |
| 4,184,272 | A | * | 1/1980 | Riggs | 36/129 |
| 4,223,459 | A | * | 9/1980 | Riggs | 36/114 |
| 4,241,524 | A | * | 12/1980 | Sink | 36/102 |
| 4,255,876 | A | | 3/1981 | Johnson | |
| 4,255,877 | A | * | 3/1981 | Bowerman | 36/129 |
| 4,272,899 | A | * | 6/1981 | Brooks | 36/129 |
| 4,393,604 | A | | 7/1983 | Crowley | |
| 4,535,554 | A | * | 8/1985 | De Obaldia B. | 36/113 |
| 4,557,059 | A | * | 12/1985 | Misevich et al. | 36/32 R |
| 4,569,142 | A | * | 2/1986 | Askinasi | 36/134 |
| 4,631,842 | A | * | 12/1986 | Koskela | 36/103 |
| 5,918,385 | A | * | 7/1999 | Sessa | 36/59 C |
| 6,101,746 | A | | 8/2000 | Evans | |
| 6,357,146 | B1 | | 3/2002 | Wordsworth et al. | |
| 6,705,027 | B1 | | 3/2004 | Campbell | |
| 6,792,698 | B2 | | 9/2004 | Kobayashi et al. | |
| 6,802,139 | B2 | * | 10/2004 | Pitts et al. | 36/51 |
| 7,010,871 | B2 | | 3/2006 | Sussmann | |
| 7,047,672 | B2 | * | 5/2006 | Hoffer et al. | 36/116 |
| 7,204,044 | B2 | | 4/2007 | Hoffer et al. | |
| 2007/0011914 | A1 | | 1/2007 | Keen et al. | |
| 2007/0113427 | A1 | * | 5/2007 | Mansfield | 36/89 |
| 2007/0199211 | A1 | | 8/2007 | Campbell | |
| 2007/0199213 | A1 | | 8/2007 | Campbell et al. | |

FOREIGN PATENT DOCUMENTS

| | | |
|---|---|---|
| WO | WO9948396 | 9/1999 |

OTHER PUBLICATIONS

International Search Report and Written Opinion, mailed Mar. 3, 2009, from PCT Application No. PCT/US2008/080079.
International Preliminary Report and Written Opinion mailed Apr. 29, 2010 in PCT Appllication No. PCT/US2008/080079.

* cited by examiner

*Primary Examiner* — Marie Patterson
(74) *Attorney, Agent, or Firm* — Plumsea Law Group, LLC

(57) ABSTRACT

An article of footwear with heel traction elements is disclosed. The heel traction elements enhance traction and stability when backpedaling or moving laterally. The heel traction elements may be disposed on a heel wrap. The heel traction elements may be disposed so they are in line with each other.

30 Claims, 5 Drawing Sheets

ARTICLE OF FOOTWEAR WITH HEEL TRACTION ELEMENTS

BACKGROUND OF THE INVENTION

1. Field of the Invention

This invention relates to an article of footwear and, more particularly, to a sports shoe with heel traction elements.

2. Description of Related Art

Articles of footwear with cleats disposed on a heel have been previously proposed. Bibollet (WO patent number 9948396A1) teaches a sole with multidirectional studs for a shoe with an upper. Bibollet teaches studs that are disposed on a heel wrap of the outsole. The studs have a generally square-like shape and have a flat engaging surface.

Campbell (U.S. Pat. No. 6,705,027) is directed to traction elements for an article of footwear. Campbell teaches a design for a golf shoe, including multiple traction elements disposed on a bottom surface of the sole. Campbell teaches cleats with a flat surface on one side and a rounded surface on a second side. In particular, Campbell teaches traction elements with flat surfaces that face sideways with respect to the longitudinal direction of the shoe.

Wordsworth (U.S. Pat. No. 6,357,146) teaches a sports footwear and studs. Wordsworth et al. teach studs that are directional. Wordsworth et al. teach heel studs that are used for breaking effects, as the inclined surface provides greater resistance than the compliant side. Wordsworth et al. also teach cleats at the forefoot. These studs in the forefoot are oriented with the inclined side directed rearwards to provide increased traction in the forward direction.

Evans (U.S. Pat. No. 6,101,746) teaches a football boot with studs. Evans teaches a stud system with a stud disposed at the rear of a heel. Furthermore, Evans teaches a rearmost stud with a shape having a flat face oriented forwards and a rounded shape oriented rearwards.

The prior art fails to teach provisions for securing the heel of a shoe with cleats as the foot is planted, while also preventing the heel from digging in when the foot is being dragged backwards, as can occur in backpedaling. There is a need in the art for a design that solves this problem.

SUMMARY OF THE INVENTION

An article of footwear including heel traction elements is disclosed. The article of footwear may be associated with one or more cleats and/or traction elements. The terms "cleat" and "traction element" as used throughout this detailed description and in the claims refers to any portion of a sole that is configured to engage a ground surface and penetrate or interweave with that surface. Examples of ground surfaces include, but are not limited to, natural turf, synthetic turf, dirt, as well as other surfaces. It should be understood that the terms cleat and traction element are not limited to portions of a sole that penetrate through a ground surface. In some cases, as with Astroturf, a cleat or traction element may only interweave with various fibers associated with the turf, and may not penetrate through the Astroturf.

In one aspect, the invention provides an article of footwear, comprising: a sole including a forefoot portion and a heel portion; the heel portion further comprising a heel wrap; a first rear heel traction element disposed on the heel wrap and a second rear heel traction element disposed on the heel wrap; each of the rear heel traction elements including a first rounded portion oriented towards the forefoot portion and each of the rear heel traction elements including a second rounded portion oriented away from the forefoot portion; the first rounded portion forming a first angle of inclination with the heel wrap that is greater than a second angle of inclination formed between the second rounded portion and the heel wrap; and where the first rear heel traction element is disposed rearwards of the second rear heel traction element In another aspect, the first rounded portion has a first average curvature that is less than an average curvature of the second rounded portion.

In another aspect, the first angle of inclination is between 60 and 90 degrees.

In another aspect, the second angle of inclination is between 0 and 30 degrees.

In another aspect, the second rear heel traction element is disposed rearwards of a rear heel cleat.

In another aspect, the first rear heel traction element is disposed against the second rear heel traction element.

In another aspect, the invention provides an article of footwear, comprising: a sole including a forefoot portion and a heel portion; the heel portion further comprising a heel wrap; a first rear heel traction element disposed on an upper portion of the heel wrap and a second rear heel traction element disposed on a lower portion of the heel wrap, the second rear heel traction element being adjacent to the first rear heel traction element; and where the first rear heel traction element has a first height that is smaller than a second height of the second rear heel traction element.

In another aspect, the first rear heel traction element is disposed above a heel cleat disposed on a flat base portion of the sole.

In another aspect, the first rear heel traction element and the second rear heel traction element have a shark fin-like shape.

In another aspect, the first rear heel traction element is disposed behind the second rear heel traction element.

In another aspect, the first rear heel traction element and the second rear heel traction element present a contact surface configured to contact a ground surface.

In another aspect, the first rear heel traction element has a first side disposed closest to the forefoot portion and a second side disposed furthest from the forefoot portion.

In another aspect, the lateral width of the first side is greater than the lateral width of the second side.

In another aspect, the second rear heel traction element has a first side disposed closest to the forefoot portion and a second side disposed furthest from the forefoot portion.

In another aspect, the lateral width of the first side is greater than the lateral width of the second side.

In another aspect, the average lateral width of the first rear heel traction element is less than the average lateral width of the second rear heel traction element.

In another aspect, the invention provides an article of footwear, comprising: a sole including a forefoot portion and a heel portion; the heel portion further comprising a heel wrap; a first rear heel traction element including a first rounded portion oriented towards the forefoot portion and a second rear heel traction element including a second rounded portion oriented away from the forefoot portion; and where the first rounded portion and the second rounded portion present a contact surface that is configured to engage a ground surface.

In another aspect, the contact surface is rounded.

In another aspect, the contact surface is configured to skim over a surface without penetrating through the surface.

In another aspect, a height of the first rear heel traction element is less than a height of the second rear heel traction element.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
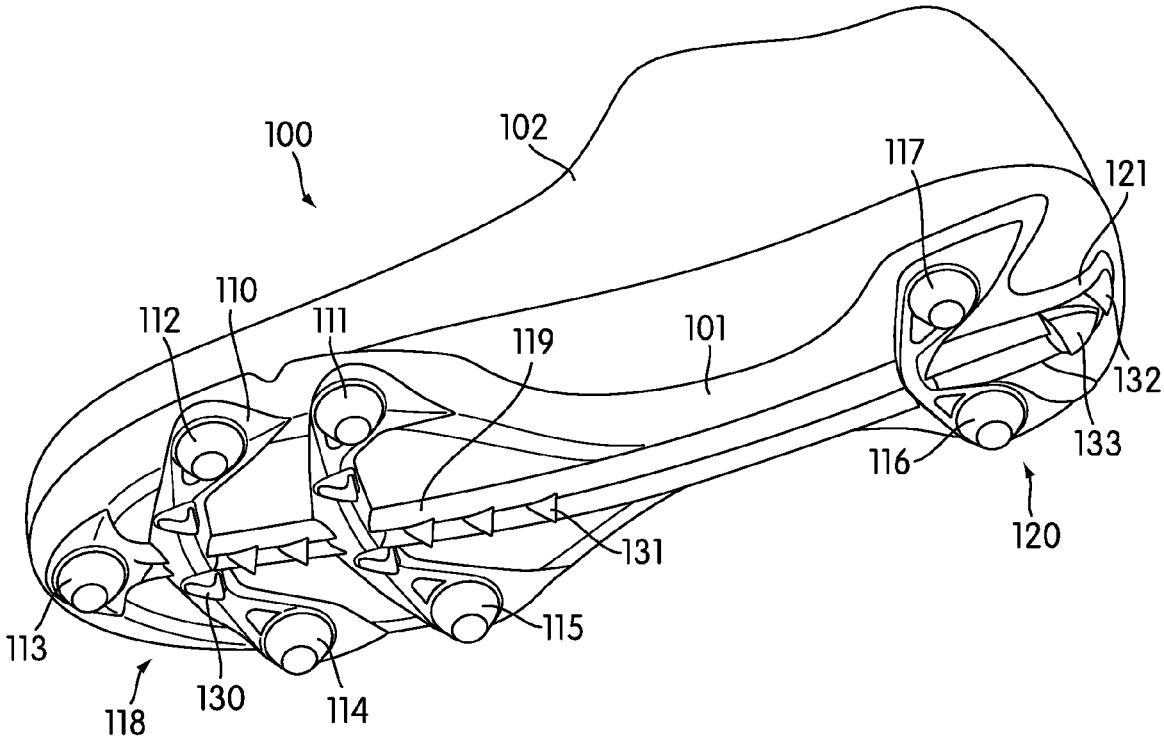
FIG. 1 is an isometric view of a preferred embodiment of an article of footwear with a sole with cleats and traction elements.
Figure 2:
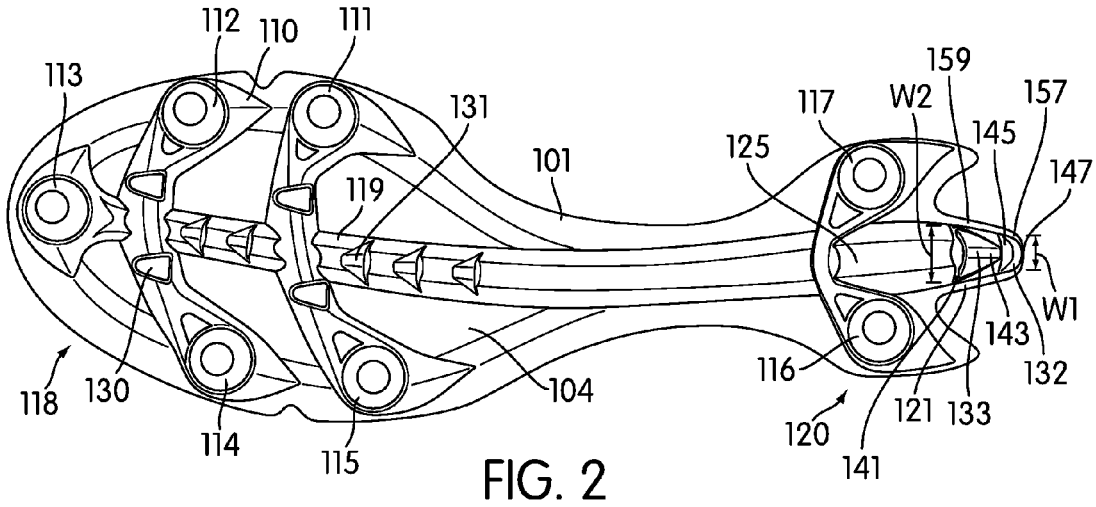
FIG. 2 is a plane view of a preferred embodiment of a sole with cleats and traction elements.
Figure 3:
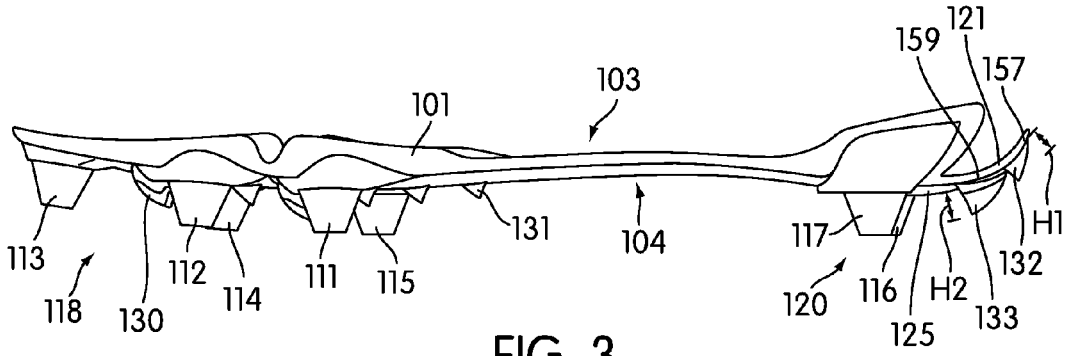
FIG. 3 is a side view of a preferred embodiment of a sole with cleats and traction elements.

FIGS. 1, 2 and 3 illustrate a preferred embodiment of sole 101. Sole 101 may be associated with article of footwear 100. For clarity, the following detailed description discusses a preferred embodiment in the form of a football shoe, but it should be noted that the present invention could take the form of any article of footwear, including, but not limited to, soccer boots, rugby shoes, baseball shoes as well as other kinds of shoes. As shown throughout the figures, article of footwear 100, also referred to as article 100, is intended to be used with a right foot. However, it should be understood that the following discussion may equally apply to a mirror image of article of footwear 100 that is intended for use with a left foot.

In some embodiments, sole 101 may be associated with upper 102. Upper 102 is preferably configured to receive a foot. The current embodiment includes a generic design for upper 102. In other embodiments, the design of upper 102 may be modified. Generally, any design for upper 102 may be used.

Sole 101 and upper 102 may be made from materials known in the art for making articles of footwear. For example, sole 101 may be made from any suitable material, including, but not limited to, elastomers, siloxanes, natural rubber, other synthetic rubbers, aluminum, steel, natural leather, synthetic leather, or plastics. Also, upper 102 may be made from any suitable material, including, but not limited to, nylon, natural leather, synthetic leather, natural rubber or synthetic rubber. Generally, upper 102 can be made of any suitable knitted, woven or non-woven material.

For purposes of clarity, sole 101 is shown in isolation in FIGS. 2 and 3. Preferably, sole 101 includes top surface 103 and bottom surface 104. Sole 101 may be configured to attach to an upper, a midsole or an insole of an article of footwear. Top surface 103 is generally configured to contact the midsole or the insole and is associated with a foot. Bottom surface 104 is preferably configured to contact a surface, such as grass or synthetic turf. In some embodiments, bottom surface 104 may also include an outer member or other components.

Preferably, sole 101 includes provisions for increasing traction with a surface, such as grass or synthetic turf. In some cases, these provisions may be cleats. In this embodiment, sole 101 includes cleat receiving members 110. In some embodiments, cleat receiving members 110 may be configured to receive removable cleats. In other embodiments, sole 101 may be associated with molded cleats. In this preferred embodiment, cleat receiving members 110 may be raised with respect to sole 101. In other embodiments, cleat receiving members 110 may be flush with sole 101.

In some embodiments, cleat receiving members 110 may be disposed on forefoot portion 118 and heel portion 120 of sole 101. In other embodiments, cleat receiving members 110 may be disposed only on forefoot portion 118. In still other embodiments, cleat receiving members 110 may be disposed only on heel portion 120. Additionally, in some cases, cleat receiving members 110 may be disposed on an arch portion of sole 101.

Cleat receiving members 110 may be configured to receive cleats or studs of some kind. In this preferred embodiment, cleat receiving members 110 are configured to receive first cleat 111, second cleat 112, third cleat 113, fourth cleat 114, and fifth cleat 115 on forefoot portion 118. Additionally, cleat receiving members 110 may be configured to receive sixth cleat 116 and seventh cleat 117 on heel portion 120 of sole 101. This preferred arrangement of cleats 111-117 may enhance traction for a wearer during cutting, turning, stopping, and acceleration.

A sole may include components other than cleats that contact a playing surface and increase traction. In some embodiments, a sole may also include traction elements that are smaller than cleats or studs. Traction elements on the sole of an article of footwear may increase control for a wearer when maneuvering forward on a surface by engaging the surface. Additionally, traction elements may also increase the wearer's stability when making lateral movements by digging into a playing surface. Generally, traction elements may be used in addition to cleats or without cleats. In this preferred embodiment, sole 101 is configured with traction elements as well as cleats.

In some embodiments, traction elements may be disposed on any portion of a sole. In some cases, for example, traction elements may be disposed on a forefoot portion of the sole. In other embodiments, traction elements may be disposed on an arch portion of a sole. In a preferred embodiment, traction elements may be disposed on a central region of the forefoot portion of a sole.

FIG. 2 clearly illustrates a plan view of a preferred embodiment of forefoot traction elements 130 disposed on a forefoot portion 118 of sole 101. Preferably, forefoot traction elements 130 include four traction elements located proximally to first cleat 111, second cleat 112, fourth cleat 114 and fifth cleat 115 on forefoot portion 118. In addition, central traction elements 131 may be disposed on central region 119 of forefoot portion 118. In this embodiment, central traction elements 131 may include five traction elements disposed in a line on central region 119. In other embodiments, more or less traction elements may be included in forefoot traction elements 130 and central traction elements 131. Generally, traction elements may be disposed in any location and in any design on sole 101 to increase the traction of article 100 when a wearer is maneuvering forward or laterally.

In some embodiments, traction elements may be pod-like protrusions from a bottom surface of a sole. In other embodiments, traction elements may be rounded or cylindrical. Generally, traction elements may have any shape that increases traction and that does not interfere with maneuverability. In a preferred embodiment, traction elements have a shark fin-like shape.

Referring to FIG. 3, forefoot traction elements 130 and central traction elements 131 have a shark fin-like shape. This shark fin-like shape has a rounded face and a flat face. Preferably, the rounded face of traction elements 130 and 131 faces forward. Furthermore, the sides of traction elements 130 and 131 are preferably rounded. This smooth curvature at the front and sides of traction elements 130 and 131 allows a wearer to run forward or laterally with little resistance from traction elements 130 and 131.

Preferably, the flat face of each of the traction elements 130 and 131 faces backward to provide traction. As the flat face of each of the traction elements 130 and 131 contacts a surface, the flat face may dig into the surface and provide traction for a wearer. Using this arrangement, traction elements 130 and 131 may provide traction when a wearer attempts to move forward or laterally and may be helpful in preventing a wearer from sliding backward.

While article of footwear 100 includes provisions for stability and traction when a wearer is moving forward and laterally, the wearer may also require traction when maneuvering backwards. Backpedaling or running backwards is an essential technique in many sports, including football, soccer, rugby and baseball, as well as other sports. In football, for example, a quarterback backpedals from a snap. Defensive backs and linebackers may also frequently backpedal in zone or man to man pass coverage. In soccer, backpedaling may be employed when defending or containing an attacker. Preferably, article of footwear 100 includes features that provide stability when backpedaling and traction to prevent inadvertent forward movement. It should be understood that the term "backpedaling" as used throughout this detailed description and in the claims refers to any type of backwards motion and is not intended to be limiting to a specific type of backwards movement.

In some embodiments, traction elements designed to provide stability when backpedaling may be disposed on a forefoot portion of an article. In other embodiments, traction elements for backpedaling may be located on an arch portion of an article. In still other embodiments, traction elements for backpedaling may be located on a heel portion of an article. In a preferred embodiment, traction elements that provide stability when backpedaling may be disposed on a heel wrap of an article of footwear.

In prior designs, heel traction elements have been placed evenly over the entire heel. This placement provides multiple contact points with a surface. While these designs may be useful for breaking from forward running, these designs may present problems when a wearer is backpedaling. Typically, when backpedaling, the wearer may alternate between moving a foot backward and planting the foot. In some cases, the foot of the wearer may drag slightly across the playing surface. A design with numerous traction elements that engage a surface may create unwanted friction when the wearer backpedals.

In this embodiment, heel portion 120 of sole 101 includes flat base portion 125 that is oriented downwards, as shown in FIGS. 2-3. Heel portion 120 also preferably includes heel wrap 121 that curves up and away from flat base portion 125. In other words, heel wrap 121 and flat base portion 125 are directed in different directions. With this arrangement, heel wrap 121 is configured to support a rear portion of a heel, while flat base portion 125 is primarily configured to support a bottom portion of a heel.

Heel wrap 121 may be associated with rear heel traction elements. In this embodiment, first rear heel traction element 132 and second rear heel traction element 133 are preferably disposed on heel wrap 121 as seen in FIGS. 2-3. Although the preferred embodiment includes two rear heel traction elements, in other embodiments, the number of rear heel traction elements may vary. In some cases, more than two traction elements configured to increase traction when backpedaling may be located on heel wrap 121 of article 100. In other cases, only one traction element for backpedaling may be disposed on heel wrap 121.

Preferably, first rear heel traction element 132 is disposed on upper portion 157 of heel wrap 121. Likewise, second rear heel traction element 133 is preferably disposed on lower portion 159 of heel wrap 121. In particular, first rear heel traction element 132 is disposed behind, or rearwards of, second rear heel traction element 133. In some embodiments, first rear heel traction element 132 is disposed against second rear heel traction element 133. As a wearer backpedals, this configuration of in line rear heel traction elements 132 and 133 provides less friction when dragging a heel over a surface than designs with multiple widely distributed contact points.

Preferably, rear heel traction elements 132 and 133 are disposed rearwards of other cleats and traction elements associated with sole 101. In this embodiment, rear heel traction elements 132 and 133 are disposed rearwards of cleats 116 and 117, which are also disposed on heel portion 120. This arrangement helps to prevent other cleats or traction elements from interfering with rear heel traction elements 132 and 133 during backpedaling or other reverse maneuvers.

In some embodiments, the sizes of rear heel traction elements 132 and 133 may be different. As seen in FIG. 2, the lateral widths of rear heel traction elements 132 and 133 may vary to provide differing types of traction at different regions of rear heel traction elements 132 and 133. In this embodiment, first rear heel traction element 132 may have a first lateral width W1 at a first end 157. Preferably, the width of first rear heel traction element 132 will decrease towards second end 147 of first rear heel traction element 132. Likewise, second rear heel traction element 133 may have a second lateral width W2 at a first end 141. Preferably, the width of second rear heel traction element 133 will decrease towards second end 143 of second rear heel traction element 133. Generally, the average lateral width of first rear heel traction element 132 may be less than the average lateral width of second rear heel traction element 133. This arrangement may facilitate insertion of rear heel traction elements 132 and 133 during planting. Also, since second heel traction element 133 is lower on heel wrap 121 and generally first to contact a surface, the greater width W2 provides greater traction capabilities for second heel traction element 133.

Figure 4:
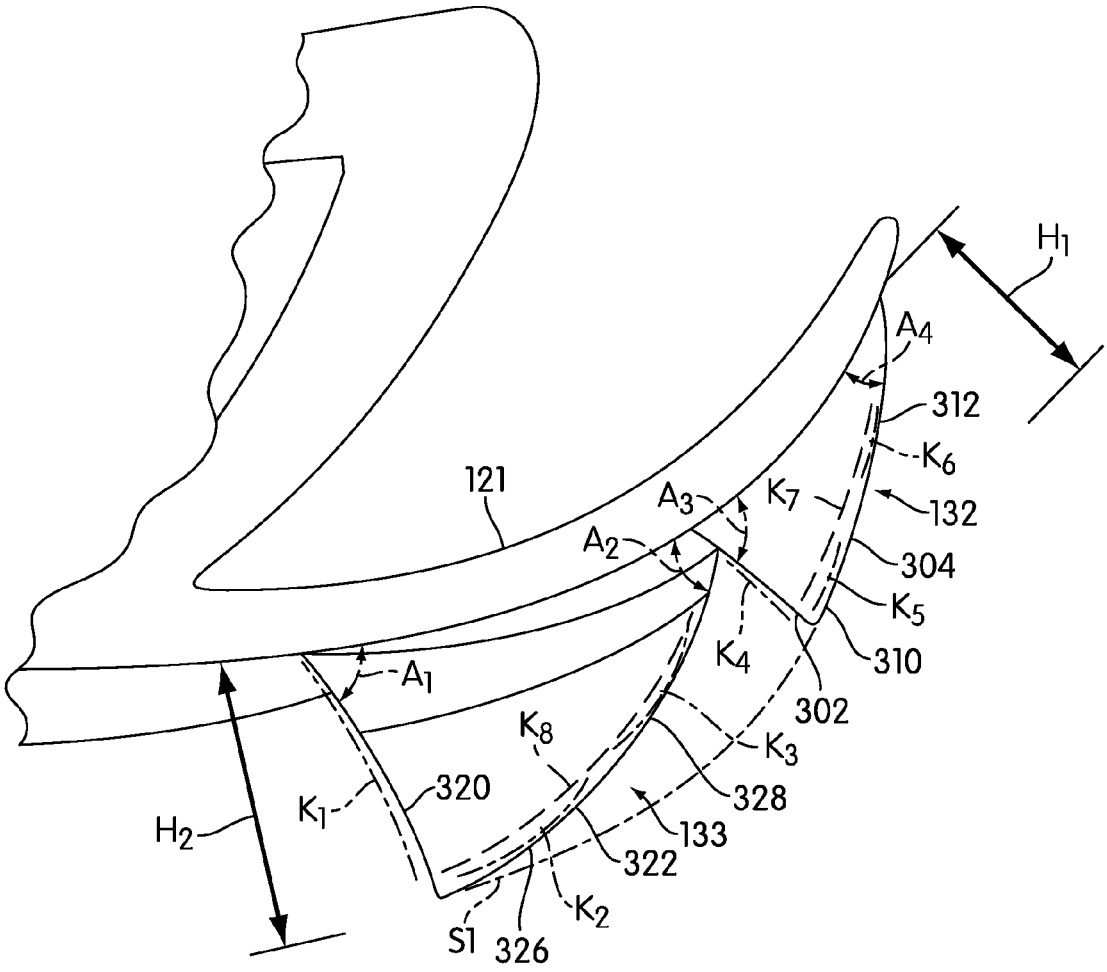
FIG. 4 is an enlarged side view of a preferred embodiment of a sole with cleat and traction elements.

Referring to FIGS. 3 and 4, the heights of rear heel traction elements 132 and 133 may also vary in order to provide modified traction capabilities at different regions of heel portion 120. In this embodiment, first rear heel traction element 132 has a height H1 with respect to heel wrap 121. Likewise, second rear heel traction element 133 has a height H2 with respect to heel wrap 121. Height H1 is preferably smaller than height H2. Using this preferred arrangement, first rear heel traction element 132 is less likely to catch and dig into a ground surface while the heel of a wearer is dragging backwards.

Preferably, the shape of rear heel traction elements 132 and 133 may also be configured to facilitate increased traction during backpedaling maneuvers. In some cases, rear heel traction elements 132 and 133 may be associated with a first rounded portion and a second rounded portion. The first rounded portion may be oriented towards a forefoot portion and configured to engage a surface during planting. A second rounded portion may be oriented away from the forefoot portion, and may be configured to drag or skim over a surface during backpedaling.

FIG. 4 is an enlarged side view of a preferred embodiment of rear heel traction elements 132 and 133. This view is intended to clearly illustrate the preferred shape of rear heel traction elements 132 and 133 as viewed from the side. It should be understood that the following discussion of the general features of rear heel traction elements 132 and 133 could also be applied to other traction elements disposed on a sole as well.

In this embodiment, first rear heel traction element 132 comprises first rounded portion 302 and second rounded portion 304. Preferably, first rounded portion 302 is oriented towards a forefoot portion of the sole, while second rounded portion 304 is oriented rearwards, away from the forefoot portion of the sole. Additionally, second rear heel traction element 133 may comprise first rounded portion 320 and second rounded portion 322 that are also oriented in the forwards direction and the rearwards direction, respectively.

Preferably, the curvature of first rear heel traction element 132 varies from first rounded portion 302 to second rounded portion 304. In this embodiment, first rounded portion 302 may have a curvature K4. Likewise, second rounded portion 304 may have a curvature K7 that is greater than K4. In other words, second rounded portion 304 may be more rounded than first rounded portion 302. It should be understood that in this case, curvature K7 may be the average curvature of second rounded portion 304, comprising the average of local curvature K5 associated with a first region 310 and local curvature K6 associated with a second region 312, for example. Likewise, curvature K4 may be an average of the local curvature associated with various regions of first rounded portion 302.

Preferably, the curvature of second rear heel traction element 133 also varies from first rounded portion 320 to second rounded portion 322. In this embodiment, first rounded portion 320 may have a curvature K1. Likewise, second rounded portion 322 may have a curvature K8 that is greater than K1. In other words, second rounded portion 322 may be more rounded than first rounded portion 320. It should be understood that in this case, curvature K8 may be the average curvature of second rounded portion 322, comprising the average of local curvature K2 associated with a first region 326 and local curvature K3 associated with a second region 328, for example. Likewise, curvature K1 may be an average of the local curvature associated with various regions of first rounded portion 320.

In some cases, the shape of rear heel traction elements 132 and 133 provides for varying angles of inclination with respect to heel wrap 121. In this embodiment, first rounded portion 302 of first rear heel traction element 132 has an inclination angle A3 with respect to heel wrap 121. Additionally, second rounded portion 304 of first rear heel traction element 132 has an inclination angle A4 with respect to heel wrap 121. Preferably, angle A3 is greater than angle A4. In some cases, angle A3 may vary in the range between 90 degrees and 60 degrees. Furthermore, angle A4 may vary in the range between 0 degrees and 30 degrees. It should be understood that angles A3 and A4 are preferably measured with respect to the local regions of heel wrap 121 disposed proximally to first rounded portion 302 and second rounded portion 304. With this arrangement, first rounded portion 302 may be oriented to prevent further forward movement when first rear heel traction element 132 is engaged with a ground surface. Likewise, in cases where first rear heel traction element 132 is moved rearwards, such as during a backpedaling maneuver or other reverse maneuvers, second rounded portion 304 may be oriented to skim or drag over a surface without penetrating through the surface.

Preferably, first rounded portion 320 of second rear heel traction element 133 has an inclination angle A1 with respect to heel wrap 121. Additionally, second rounded portion 322 of second rear heel traction element 133 has an inclination angle A2 with respect to heel wrap 121. Preferably, angle A1 is greater than angle A2. In some cases, angle A1 may vary in the range between 90 degrees and 60 degrees. Furthermore, angle A2 may vary in the range between 0 degrees and 30 degrees. It should be understood that angles A1 and A2 are preferably measured with respect to the local regions of heel wrap 121 disposed proximally to first rounded portion 320 and second rounded portion 322. With this arrangement, first rounded portion 320 may be oriented to prevent further forward movement when second rear heel traction element 133 is engaged with a ground surface. Likewise, in cases where second rear heel traction element 133 is moved rearwards, such as during backpedaling or other reverse maneuvers, second rounded portion 322 may be oriented to skim or drag over a surface without penetrating through the surface.

Preferably, a set of rear heel cleats includes provisions for contacting a ground surface without penetrating or interweaving with the ground surface. In some embodiments, rear heel traction elements may present a contact surface that is configured to engage with a playing surface. In a preferred embodiment, the contact surface may be generally rounded and may be configured to skim over a surface or drag over a surface in a manner that minimizes friction and prevents penetration of the traction element into the surface.

Referring to FIG. 4, second rounded portions 304 and 322 may present a contact surface S1. Generally, contact surface S1 may be approximately coincident with a portion of second rounded portions 304 and 322. In this case, second rounded portions 304 and 322 allow for two contact points that may reduce the tendency for either of rear heel cleats 132 and 133 to penetrate through the ground surface.

Figure 5:
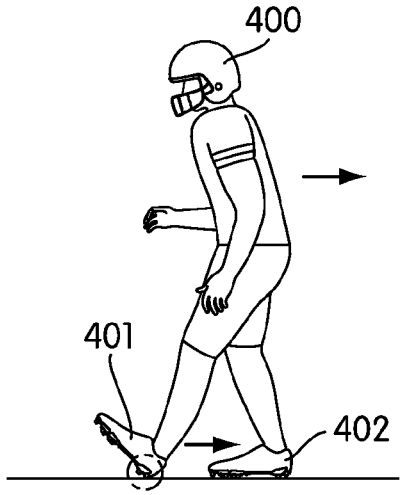
FIG. 5 is an exemplary embodiment of a football player backpedaling.
Figure 5:
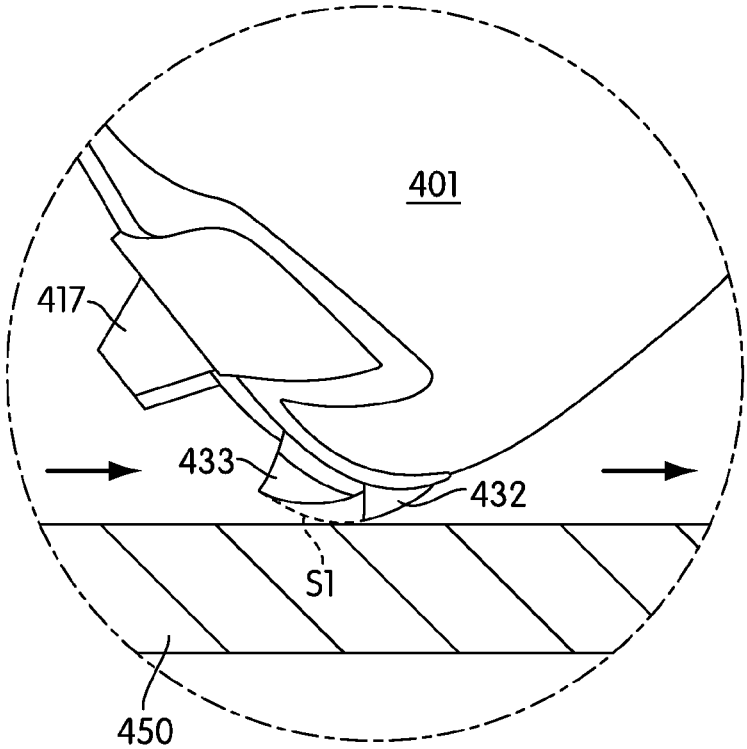
Figure 6:
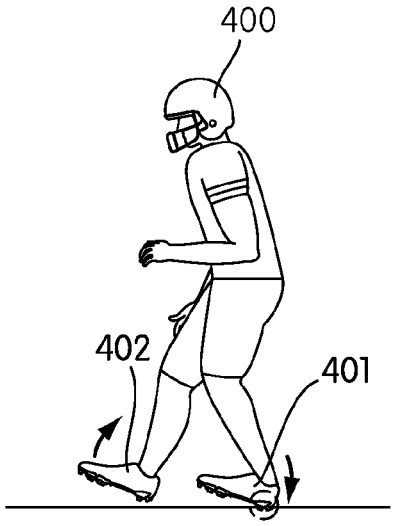
FIG. 6 is an exemplary embodiment of a football player planting a foot after backpedaling.
Figure 6:
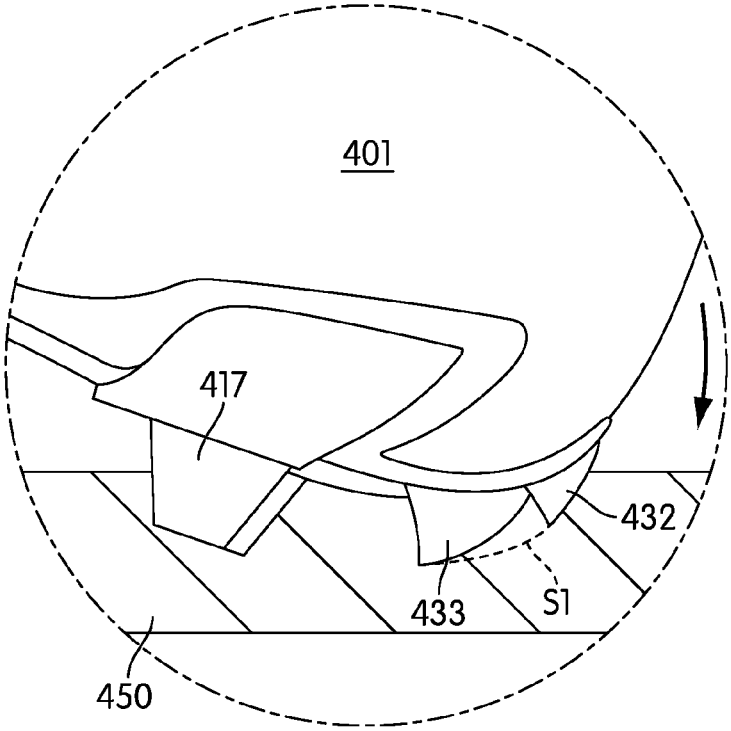

FIGS. 5 and 6 illustrate an exemplary embodiment of player 400 backpedaling. Player 400 is preferably wearing a pair of articles of footwear including provisions described in the previous embodiment and seen in FIGS. 1-4. Generally, player 400 may play any sport and may play any position. In this preferred embodiment, football player 400 may be a cornerback in football.

Referring to FIG. 5, player 400 is backpedaling with right article 401 elevated and moving rearwards as left article 402 is planted. A close-up view of a portion of right article 401 shows right article 401 moving backward and skimming or dragging on surface 450. When right article 401 skims surface 450, first rear heel traction element 432 and second rear heel traction element 433 contact surface 450, but do not penetrate surface 450. As discussed previously, the coincident rounded portions of rear heel traction elements 432 and 433 present a rounded contact surface S1 that preferably does not catch on surface 450. Instead, rear heel traction elements 432 and 433 slide over surface 450. Additionally, right article 401 is extended at an angle so that cleat 417 and other cleats not visible do not contact surface 450. This preferred arrangement allows player 400 to move right article 401 backward smoothly as player 400 backpedals.

At some point during backpedaling, player 400 may plant right article 401 and lift left article 402 in preparation for moving it backward. FIG. 6 illustrates an exemplary embodiment of player 400 preparing to plant right article 401 and lifting left article 402. As right article 401 is planted, rear heel traction elements 432 and 433 engage and penetrate through surface 450. The forward facing rounded portions of heel traction elements 432 and 433 preferably dig into surface 450 to provide traction as player 400 backpedals.

In some cases, cleat 417 and other cleats not visible in this Figure may also engage surface 450 as player 400 plants right article 401. Since rear heel traction elements 432 and 433 are disposed on the heel wrap of right article 401, rear heel traction elements 432 and 433 may contact surface 450 before cleat 417 and other cleats located on a heel of right article 401. By digging into surface 450, rear heel traction elements 432 and 433 provide traction in a backwards direction as player 400 plants right article 401 and lifts left article 402. At this point, player 400 may move left article 402 backward in the same manner as shown in FIG. 5 to continue backpedaling.

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

I claim:

1. An article of footwear, comprising:

a sole including a forefoot portion and a heel portion;

the heel portion further comprising a heel wrap;

a first rear heel traction element disposed on the heel wrap and a second rear heel traction element disposed on the heel wrap;

each of the rear heel traction elements including a first rounded portion oriented towards the forefoot portion and each of the rear heel traction elements including a second rounded portion oriented away from the forefoot portion;

the first rounded portion forming a first angle of inclination with the heel wrap that is greater than a second angle of inclination formed between the second rounded portion and the heel wrap; and wherein the first rear heel traction element is disposed rearwards of the second rear heel traction element.

2. The article of footwear according to claim 1, wherein the first rounded portion has a first average curvature that is less than an average curvature of the second rounded portion.

3. The article of footwear according to claim 1, wherein the first angle of inclination is between 60 and 90 degrees.

4. The article of footwear according to claim 1, wherein the second angle of inclination is between 0 and 30 degrees.

5. The article of footwear according to claim 1, wherein the second rear heel traction element is disposed rearwards of a rear heel cleat.

6. The article of footwear according to claim 1, wherein the first rear heel traction element is disposed against the second rear heel traction element.

7. An article of footwear, comprising:

a sole including a forefoot portion and a heel portion;

the heel portion further comprising a heel wrap;

a first rear heel traction element disposed on an upper portion of the heel wrap and a second rear heel traction element disposed on a lower portion of the heel wrap, the second rear heel traction element being adjacent to the first rear heel traction element;

wherein the first rear heel traction element has a first height that is smaller than a second height of the second rear heel traction element; and wherein the average lateral width of the first rear heel traction element is less than the average lateral width of the second rear heel traction element.

8. The article of footwear according to claim 7, wherein the first rear heel traction element is disposed above a heel cleat disposed on a flat base portion of the sole.

9. The article of footwear according to claim 7, wherein the first rear heel traction element and the second rear heel traction element have a generally triangular shape.

10. The article of footwear according to claim 7, wherein the first rear heel traction element is disposed behind the second rear heel traction element.

11. The article of footwear according to claim 7, wherein the first rear heel traction element and the second rear heel traction element present a contact surface configured to contact a ground surface.

12. The article of footwear according to claim 7, wherein the first rear heel traction element has a first side disposed closest to the forefoot portion and a second side disposed furthest from the forefoot portion.

13. The article of footwear according to claim 12, wherein the lateral width of the first side is greater than the lateral width of the second side.

14. The article of footwear according to claim 7, wherein the second rear heel traction element has a first side disposed closest to the forefoot portion and a second side disposed furthest from the forefoot portion.

15. The article of footwear according to claim 14, wherein the lateral width of the first side is greater than the lateral width of the second side.

16. The article of footwear according to claim 7, wherein a cleat receiving member is disposed on the heel portion.

17. An article of footwear, comprising:

a sole including a forefoot portion and a heel portion having a heel width;

the heel portion further comprising a heel wrap;

a first rear heel traction element including a forward facing first rounded portion oriented towards the forefoot portion and a second rear heel traction element including-a rearward facing second rounded portion oriented away from the forefoot portion;

wherein the rearward facing second rounded portion having a first width presents a contact surface that is configured to contact a ground surface;

wherein the forward facing first rounded portion having a second width is configured to penetrate the ground surface;

wherein the heel width is greater than the first width and second width.

18. The article of footwear according to claim 17, wherein the contact surface is rounded.

19. The article of footwear according to claim 17, wherein a cleat receiving member is disposed on the heel portion.

20. The article of footwear according to claim 17, wherein a height of the first rear heel traction element is less than a height of the second rear heel traction element.

21. An article of footwear, comprising:

a sole including a forefoot portion and a heel portion;

the heel portion further comprising a heel wrap;

a first rear heel traction element disposed on an upper portion of the heel wrap and a second rear heel traction element disposed on a lower portion of the heel wrap, the second rear heel traction element being adjacent to the first rear heel traction element;

wherein the first rear heel traction element has a first height that is smaller than a second height of the second rear heel traction element;

wherein the first rear heel traction element has a first side disposed closest to the forefoot portion and a second side disposed furthest from the forefoot portion; and wherein the lateral width of the first side is greater than the lateral width of the second side.

22. The article of footwear according to claim 21, wherein a cleat receiving member is disposed on the heel portion.

23. The article of footwear according to claim 22, wherein the cleat receiving member is disposed closer to the forefoot portion than the first rear heel traction element and the second rear heel traction element.

24. The article of footwear according to claim 23, wherein a cleat member is disposed on the cleat receiving member.

25. The article of footwear according to claim 21, wherein a cleat receiving member is disposed on the forefoot portion.

26. An article of footwear, comprising:

a sole including a forefoot portion and a heel portion;

the heel portion further comprising a heel wrap;

a first rear heel traction element disposed on an upper portion of the heel wrap and a second rear heel traction element disposed on a lower portion of the heel wrap, the second rear heel traction element being adjacent to the first rear heel traction element;

wherein the first rear heel traction element has a first height that is smaller than a second height of the second rear heel traction element;

wherein the second rear heel traction element has a first side disposed closest to the forefoot portion and a second side disposed furthest from the forefoot portion; and wherein the lateral width of the first side is greater than the lateral width of the second side.

27. The article of footwear according to claim 26, wherein a cleat receiving member is disposed on the heel portion.

28. The article of footwear according to claim 27, wherein the cleat receiving member is disposed closer to the forefoot portion than the first rear heel traction element and the second rear heel traction element.

29. The article of footwear according to claim 28, wherein a cleat member is disposed on the cleat receiving member.

30. The article of footwear according to claim 26, wherein a cleat receiving member is disposed on the forefoot portion.

* * * * *